US011267098B2

(12) United States Patent
Yun et al.

(10) Patent No.: US 11,267,098 B2
(45) Date of Patent: Mar. 8, 2022

(54) LEAKAGE-PROOF POLISHING PAD AND PROCESS FOR PREPARING THE SAME

(71) Applicant: SKC solmics Co., Ltd., Gyeonggi-do (KR)

(72) Inventors: Sunghoon Yun, Gyeonggi-do (KR); Jang Won Seo, Busan (KR); Tae Kyoung Kwon, Ulsan (KR); Jaein Ahn, Gyeonggi-do (KR); Jong Wook Yun, Gyeonggi-do (KR); Hye Young Heo, Gyeonggi-do (KR)

(73) Assignee: SKC solmics Co., Ltd., Gyeonggi-do (KR)

( * ) Notice: Subject to any disclaimer, the term of this patent is extended or adjusted under 35 U.S.C. 154(b) by 631 days.

(21) Appl. No.: 16/160,418

(22) Filed: Oct. 15, 2018

(65) Prior Publication Data

US 2019/0111542 A1 Apr. 18, 2019

(30) Foreign Application Priority Data

Oct. 16, 2017 (KR) ..... 10-2017-0133792
Mar. 29, 2018 (KR) ..... 10-2018-0036696

(51) Int. Cl.
*B24B 37/20* (2012.01)
*B24B 53/017* (2012.01)
*B24B 37/22* (2012.01)

(52) U.S. Cl.
CPC ..... *B24B 37/205* (2013.01); *B24B 37/22* (2013.01); *B24B 53/017* (2013.01)

(58) Field of Classification Search
CPC ..... B24B 49/12; B24B 37/013; B24D 7/12; B24D 11/001
See application file for complete search history.

(56) References Cited

U.S. PATENT DOCUMENTS 6,045,439 A * 4/2000 Birang ..... B24B 49/04 451/526
6,254,459 B1 * 7/2001 Bajaj ..... B24B 21/04 451/41
6,464,576 B1 * 10/2002 Freeman ..... B24B 37/22 451/533
7,179,151 B1 * 2/2007 Bottema ..... B24B 37/013 451/285
7,621,798 B1 * 11/2009 Bennett ..... B24B 37/205 451/527
2003/0129931 A1 * 7/2003 Konno ..... B24B 37/205 451/285

(Continued)

FOREIGN PATENT DOCUMENTS

JP 2007-229811 A 9/2007
JP 2013-52459 A 3/2013

(Continued)

OTHER PUBLICATIONS

Office Action issued by the Korean Intellectual Property Office dated May 15, 2019.

(Continued)

*Primary Examiner* — Joel D Crandall
(74) *Attorney, Agent, or Firm* — IP & T Group LLP

(57) ABSTRACT

Embodiments relate to a leakage-proof polishing pad for use in a chemical mechanical planarization (CMP) process and a process for producing the same.

21 Claims, 9 Drawing Sheets

(56) References Cited

U.S. PATENT DOCUMENTS

| | | | | |
|---|---|---|---|---|
| 2004/0018809 | A1* | 1/2004 | Petroski | B24B 37/24 451/537 |
| 2007/0281587 | A1 | 12/2007 | Wiswesser et al. | |
| 2009/0253353 | A1* | 10/2009 | Ogawa | B24B 37/205 451/41 |
| 2017/0246722 | A1* | 8/2017 | Hu | B24B 37/24 |

FOREIGN PATENT DOCUMENTS

| | | |
|---|---|---|
| KR | 10-2001-0089717 | 10/2001 |
| KR | 100380785 | 8/2003 |
| KR | 100646887 | 11/2006 |
| KR | 1020080100277 | 11/2008 |
| KR | 100903473 | 6/2009 |
| KR | 10-2010-0043024 | 4/2010 |
| KR | 101572464 | 11/2015 |
| TW | 450874 B | 8/2001 |
| TW | 200408496 | 6/2004 |
| TW | 200413133 | 8/2004 |

OTHER PUBLICATIONS

Office Action issued by the Chinese Patent Office dated Dec. 1, 2020.
Office Action issued by the Taiwanese Intellectual Property Office dated Aug. 12, 2019.
Office Action issued by the Taiwanese Inteliectual Property Office dated Jan. 7, 2020.
Office Action issued by the Japan Patent Office dated Jan. 7, 2020.
Office Action by the Korean Intellectual Property Office dated Dec. 20, 2017.

* cited by examiner

LEAKAGE-PROOF POLISHING PAD AND PROCESS FOR PREPARING THE SAME

The present application claims priority of Korean patent application number 10-2017-0133792, Korean patent application number 10-2018-0036696, filed on Oct. 16, 2017 and Mar. 29, 2018, respectively, which are incorporated herein by reference in its entirety.

TECHNICAL FIELD

Embodiments relate to a leakage-proof polishing pad for use in a chemical mechanical planarization (CMP) process of semiconductors and a process for preparing the same.

BACKGROUND ART

A polishing pad for a CMP process is an essential element that plays an important role in the CMP process for the fabrication of semiconductors. It plays an important role in materializing the performance of the CMP process. A polishing pad for a CMP process serves to remove unnecessary portions on a wafer and makes the surface of the wafer smooth through a uniform polishing operation during the CMP process.

In recent years, various methods have been proposed to detect the thickness of a wafer and to determine the termination point of the CMP process. For example, in order to in-situ determine the flatness of the surface of a wafer, a method has been proposed in which a window is mounted in a polishing pad, and the thickness of the wafer is measured through a reflected beam generated by the interference of a laser through the window. Several methods for mounting a window in a polishing pad have been proposed. For example, there have been proposed a method of inserting and integrating a window block in the step of forming a polishing layer (see Korean Patent No. 10-0646887), and a method in which a polishing layer is punched and a window block separately prepared is inserted into the punched hole (a so-called "a window-inserted polishing pad") (see Korean Patent No. 10-0903473).

Meanwhile, a window-inserted polishing pad has a disadvantage in that leakage occurs during a CMP process due to the gap between the polishing layer and the window block. It is urgent to develop a polishing pad having excellent airtightness in order to prevent the leakage that may occur in a CMP process.

PRIOR ART DOCUMENT

Patent Document (Patent Document 1) Korean Patent No. 10-0646887
(Patent Document 2) Korean Patent No. 10-0903473

DISCLOSURE OF INVENTION

Technical Problem

Embodiments are to provide a polishing pad having excellent airtightness, so that it is capable of preventing leakage that may occur during a CMP process, and a process for preparing the same.

Solution to the Problem

The polishing pad according to an embodiment comprises a polishing layer having a first penetrating hole; a support layer disposed under the polishing layer; and a window disposed in the first penetrating hole, wherein the support layer comprises at least one compressed region selected from a first compressed region disposed in a region corresponding to the outer peripheral region of the window and a second compressed region disposed in a region corresponding to the inner peripheral region of the window.

The process for preparing a polishing pad according to an embodiment comprises (1) preparing a polishing layer having a first penetrating hole; (2) adhering a support layer to the lower side of the polishing layer; (3) inserting a window into the first penetrating hole; and (4) (4-1) pressing the lower side of the support layer to form a first compressed region in a region of the support layer that corresponds to the outer peripheral region of the window, and (4-2) pressing the window to form a second compressed region in a region of the support layer that corresponds to the inner peripheral region of the window.

Advantageous Effects of the Invention

The polishing pad according to the embodiments has excellent airtightness between a polishing layer and a window. Thus, it is possible to suppress the leakage of a slurry during a polishing process such as a CMP process.

Specifically, the support layer of the polishing pad comprises a compressed region. Since the compressed region has been compressed by heat and/or pressure to have a low porosity, it is possible to prevent leakage of water or a slurry without a separate leakage-proof layer.

In addition, even if a slurry is leaked between the window and the polishing layer, the compressed region of the polishing pad can secondarily suppress the leakage of the slurry.

In particular, since the support layer of the polishing pad is compressed in the outer peripheral region of the window, the effect of suppressing the leakage of water as described above is excellent. The compression can be readily carried out by pressing the lower side of the support layer, which is advantageously applicable to the industry.

DETAILED DESCRIPTION FOR CARRYING OUT THE INVENTION

Hereinafter, the present invention will be described in detail with reference to embodiments. The embodiments are not limited to what has been disclosed below. The embodiments may be modified into various forms as long as the gist of the invention is not altered.

Throughout the description of the embodiments, in the case where each layer, hole, window, or region is mentioned to be formed "on" or "under" another layer, hole, window, or region, it means not only that one element is directly formed on or under another element, but also that one element is indirectly formed on or under another element with other element(s) interposed between them.

In addition, the term "on" or "under" with respect to each element may be referenced to the drawings. For the sake of description, the sizes of individual elements in the appended drawings may be exaggeratingly depicted and do not indicate the actual sizes.

Figure 1:
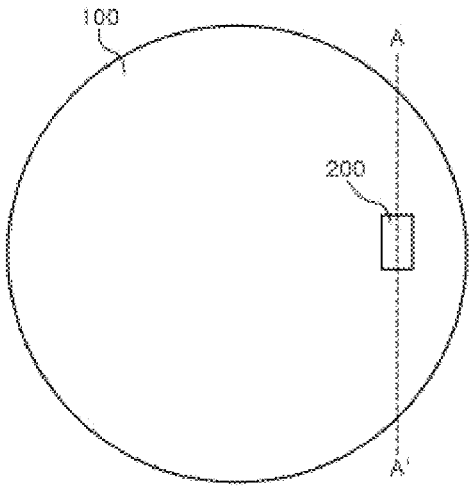
FIG. 1 is the plan view of a polishing pad according to an embodiment.

FIG. 1 is the plan view of a polishing pad according to an embodiment.

The polishing pad according to an embodiment comprises a polishing layer (100) having a first penetrating hole (130); a support layer (400) disposed under the polishing layer; and a window (200) disposed in the first penetrating hole, wherein the support layer comprises at least one compressed region selected from a first compressed region (CR1) disposed in a region corresponding to the outer peripheral region of the window and a second compressed region (CR2) disposed in a region corresponding to the inner peripheral region of the window.

Figure 2:
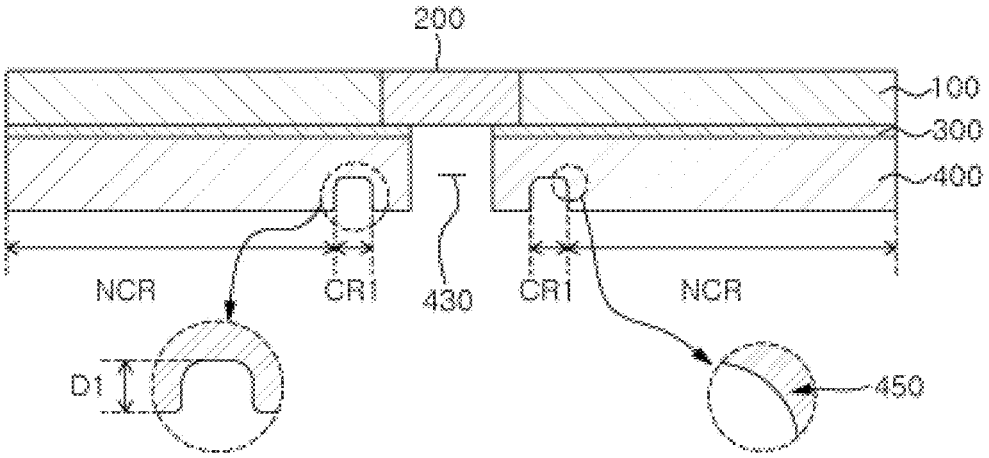
FIG. 2 is a cross-sectional view (cut along the line A-A' in FIG. 1) of a polishing pad according to an embodiment.

FIG. 2 is a cross-sectional view (cut along the line A-A' in FIG. 1) of a polishing pad according to an embodiment. Specifically, FIG. 2 exemplifies a polishing pad, which comprises a polishing layer (100) having a first penetrating hole (130); a support layer (400) disposed under the polishing layer; and a window (200) disposed in the first penetrating hole, wherein the support layer comprises a first compressed region (CR1) disposed in a region corresponding to the outer peripheral region of the window.

Figure 3:
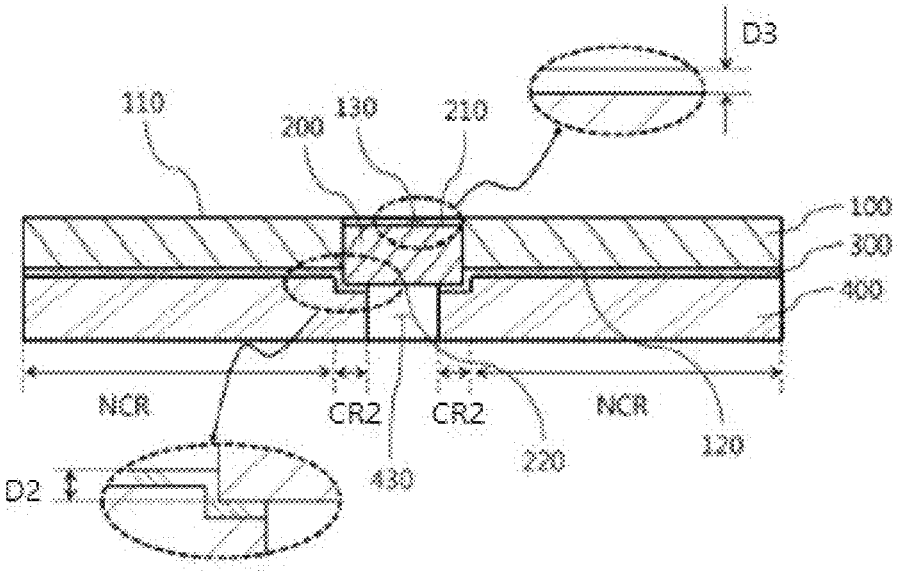
FIG. 3 is a cross-sectional view of a polishing pad according to another embodiment.

FIG. 3 is a cross-sectional view of a polishing pad according to another embodiment. Specifically, FIG. 3 exemplifies a polishing pad, which comprises a polishing layer (100) having a first penetrating hole (130); a support layer (400) disposed under the polishing layer; and a second compressed region (CR2) disposed in a region corresponding to the inner peripheral region of the window.

Figure 4:
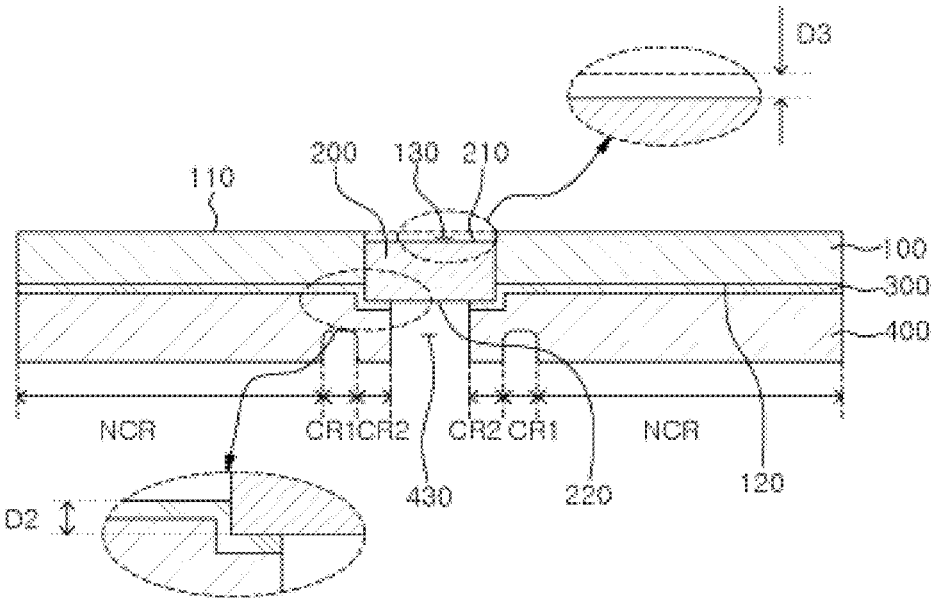
FIG. 4 is a cross-sectional view of a polishing pad according to still another embodiment.

FIG. 4 is a cross-sectional view of a polishing pad according to still another embodiment. Specifically, FIG. 4 exemplifies a polishing pad, which comprises a polishing layer (100) having a first penetrating hole (130); a support layer (400) disposed under the polishing layer; and a window (200) disposed in the first penetrating hole, wherein the support layer comprises a first compressed region (CR1) disposed in a region corresponding to the outer peripheral region of the window and a second compressed region (CR2) disposed in a region corresponding to the inner peripheral region of the window.

Polishing Layer (100)

The polishing layer (100) may be formed from a polishing layer composition that comprises a first urethane-based prepolymer, a curing agent, and a foaming agent.

A prepolymer generally refers to a polymer having a relatively low molecular weight wherein the degree of polymerization is adjusted to an intermediate level so as to conveniently mold a molded article to be finally produced in the process of producing the same.

A prepolymer may be molded by itself or after a reaction with another polymerizable compound. Specifically, the first urethane-based prepolymer may be prepared by reacting an isocyanate compound with a polyol and may comprise an unreacted isocyanate group (NCO).

The curing agent may be at least one selected from the group consisting of an amine compound and an alcohol compound. Specifically, the curing agent may comprise at least one compound selected from the group consisting of an aromatic amine, an aliphatic amine, an aromatic alcohol, and an aliphatic alcohol.

The foaming agent is not particularly limited as long as it is commonly used for forming voids in a polishing pad. For example, the foaming agent may be at least one selected from a solid foaming agent having a void structure, a liquid foaming agent using a volatile liquid, and an inert gas.

The polishing layer (100) may contain pores. The pores may have a structure of a closed cell. The average diameter of the pores may be 5 μm to 200 μm. In addition, the polishing layer (100) may contain 20% by volume to 70% by volume of pores with respect to the total volume of the polishing layer. That is, the porosity of the polishing layer (100) may be 20% by volume to 70% by volume.

The thickness of the polishing layer (100) is not particularly limited. Specifically, the average thickness of the polishing layer (100) may be 0.8 mm to 5.0 mm, 1.0 mm to 4.0 mm, 1.0 mm to 3.0 mm, 1.5 mm to 2.5 mm, 1.7 mm to 2.3 mm, or 2.0 mm to 2.1 mm.

The upper side (110) of the polishing layer may have a concave-convex structure in order to maintain and replace a slurry. In addition, the concave-convex structure generally has a regularity; however, it is possible to change the groove pitch, groove width, groove depth, and the like at specific positions for the purpose of maintaining and replacing a slurry.

The polishing layer (100) has a first penetrating hole (130) that passes through it in the thickness direction.

That is, the first penetrating hole (130) passes through the polishing layer (100) from the upper side (110) to the lower side (120) thereof.

The first penetrating hole (130) may have various plane shapes. For example, the first penetrating hole (130) may have such a polygonal shape as square and rectangle, or a shape of a circle or an ellipse.

The diameter (or width) of the first penetrating hole (130) may be 10 mm to 100 mm. In addition, the area of the first penetrating hole (130), that is, the area of the first penetrating hole (130) in the plane of the polishing layer (100) may be 1 $cm^2$ to 70 $cm^2$, 3 $cm^2$ to 40 $cm^2$, or 6 $cm^2$ to 15 $cm^2$.

Window (200)

The window (200) may be formed from a window composition that comprises a second urethane-based prepolymer and a curing agent. The second urethane-based prepolymer may be prepared by reacting an isocyanate compound with a polyol and may comprise an unreacted isocyanate group (NCO).

The curing agent may be at least one selected from the group consisting of an amine compound and an alcohol compound. Specifically, the curing agent may comprise at least one compound selected from the group consisting of an aromatic amine, an aliphatic amine, an aromatic alcohol, and an aliphatic alcohol.

The window (200) may have the same size as the diameter (or width) of the first penetrating hole. Specifically, the window (200) may have the same area as the area of the first penetrating hole (130) of the polishing layer (100). The window (200) is a non-foam. Since the window (200) has no microbubbles therein, it is possible to reduce the possibility for a polishing liquid to penetrate into the polishing pad, resulting in improvements in the accuracy of optically detecting the termination point and prevention of damage to the light transmission region.

The window (200) may have a wear rate that is the same as, or slightly higher than, the wear rate of the polishing layer (100). Thus, it is possible to prevent the problem that the window (200) portion only is protruded after polishing is carried out for a certain period of time, whereby scratches are generated on the wafer to be polished.

According to an embodiment, at least a part of the lower side of the window (200) may be disposed further below the lower side (120) of the polishing layer. The difference in height (D2) between the lower side (120) of the polishing layer and the lower side (220) of the window may be 0.1 mm to 1.0 mm. For example, the difference in height (D2) between the lower side (120) of the polishing layer and the lower side (220) of the window may be 0.1 to 0.6 mm, 0.2 to 0.6 mm, or 0.2 to 0.4 mm (see FIGS. 3 and 4).

According to an embodiment, the upper side (210) of the window may be as high as the upper side (110) of the polishing layer or may be lower than the upper side (110) of the polishing layer.

According to an embodiment, the upper side (210) of the window may be as high as the upper side (110) of the polishing layer. That is, the upper side (210) of the window and the upper side (110) of the polishing layer may be disposed on the same plane (see FIG. 2).

According to an embodiment, the upper side (210) of the window may be disposed further below the upper side (110) of the polishing layer. The difference in height (D3) between the upper side (110) of the polishing layer and the upper side (210) of the window may be 0.001 mm to 0.05 mm. For example, the difference in height (D3) between the upper side (110) of the polishing layer and the upper side (210) of the window may be 0.001 mm to 0.05 mm, 0.01 mm to 0.05 mm, or 0.02 mm to 0.03 mm (see FIGS. 3 and 4).

In addition, the thickness of the window (200) may be 2.0 mm to 3.0 mm. For example, it may be 2.1 mm to 2.8 mm, 2.3 mm to 2.8 mm, 2.2 mm to 2.6 mm, or 2.3 mm to 2.4 mm.

According to an embodiment, the thickness of the window (200) may be greater than the thickness of the polishing layer (100). For example, the thickness of the window (200) may be greater than the thickness of the polishing layer (100) by 0.1 mm to 1.0 mm.

According to an embodiment, the window (200) may comprise a recess (230) on the lower side thereof. Specifically, the depth (D4) of the recess may be 0.1 mm to 2.5 mm, 1.0 mm to 2.0 mm, or 1.5 mm to 2.0 mm (see FIG. 5*d*).

When the thickness of the window (200) is 2.3 to 2.5 mm, the light transmittance of the window (200) may be 60 to 80% and the refractive index thereof may be 1.45 to 1.60. Specifically, when the thickness of the window (200) is 2.4 mm, the light transmittance of the window (200) may be 65 to 75% and the refractive index thereof may be 1.53 to 1.57.

Support Layer (400)

The polishing pad comprises a support layer (400) disposed under the lower side of the polishing layer (100). The support layer (400) serves to support the polishing layer (100) and to absorb and disperse an impact applied to the polishing layer (100). The hardness of the support layer (400) may be smaller than the hardness of the polishing layer (100).

The support layer (400) may comprise a nonwoven fabric or a porous pad. The support layer (400) may contain pores. The pores contained in the support layer (400) may have a structure of an opened cell.

The pores contained in the support layer (400) may have a shape that extends in the thickness direction of the support layer (400). In addition, the porosity of the support layer (400) may be greater than the porosity of the polishing layer (100).

According to an embodiment, the support layer (400) may comprise a second penetrating hole (430) connected to the first penetrating hole (130) (see FIGS. 3 and 4). The second penetrating hole (430) may pass through the support layer (400) in the thickness direction thereof. That is, the second penetrating hole (430) passes through the support layer (400) from the upper side to the lower side thereof.

The second penetrating hole (430) may be connected to the first penetrating hole (130). Specifically, the second penetrating hole (430) may be disposed in a region corresponding to the region in which the first penetrating hole (130) is formed.

Meanwhile, the second penetrating hole (430) may have an area smaller than the area of the first penetrating hole (130). Specifically, the second penetrating hole (430) may have an area (i.e., the area of the second penetrating hole in the plane of the support layer) of 0.5 $cm^2$ to 50 $cm^2$, 2 $cm^2$ to 30 $cm^2$, or 4 $cm^2$ to 12 $cm^2$.

First Compressed Region (CR1) and Second Compressed Region (CR2)

According to an embodiment, the support layer (400) of the polishing pad may comprise at least one compressed region selected from a first compressed region (CR1) disposed in a region corresponding to the outer peripheral region of the window (200) and a second compressed region (CR2) disposed in a region corresponding to the inner peripheral region of the window (200).

Referring to FIG. 2, the support layer (400) comprises a first compressed region (CR1) in a region corresponding to the outer peripheral region of the window (200).

In such event, the outer peripheral region of the window (200) may correspond to a region positioned in a range of greater than about 0 mm to 10 mm from the boundary between the window (200) and the polishing layer (100) in the direction toward the polishing layer (100). For example, it may correspond to a region positioned in a range of about 0.5 mm to 10 mm or 1 mm to 3 mm.

If the first compressed region (CR1) is positioned within the above range, it is advantageous in preventing a slurry and water from flowing into the support layer during the course of a polishing process. This minimizes a change in the compressibility of the support layer by the penetration of a slurry and water, thereby contributing to achieving a uniform polishing rate.

Referring to FIG. 3, the support layer (400) may comprise a second compressed region (CR2) in a region corresponding to the inner peripheral region of the window (200). In such event, the inner peripheral region of the window (200) may correspond to a region positioned in a range of greater than about 0 mm to 15 mm or 1 mm to 3 mm from the boundary between the window (200) and the polishing layer (100) in the direction toward the window (200).

If the second compressed region (CR2) is positioned within the above range, it is advantageous in preventing a slurry and water from flowing into the support layer (400) during the course of a polishing process. This minimizes a change in the compressibility of the support layer by the penetration of a slurry and water, thereby contributing to achieving a uniform polishing rate.

The second compressed region (CR2) may be disposed around the second penetrating hole (430). In addition, the second compressed region (CR2) corresponds to the lower side (220) of the window. That is, the second compressed region (CR2) may be disposed around the second penetrating hole (430) and in a region facing the lower side (220) of the window (see FIGS. 3 and 4).

Referring to FIG. 4, the support layer (400) may comprise a first compressed region (CR1) in a region corresponding to the outer peripheral region of the window (200) and a second compressed region (CR2) in a region corresponding to the inner peripheral region of the window (200). In such event, the description on the inner peripheral region and the outer peripheral region of the window (200) is the same as described above.

According to an embodiment, the support layer (400) comprises a non-compression region (NCR) in a region excluding the first compressed region (CR1) or the second compressed region (CR2). Specifically, the support layer (400) may comprise one or more compressed regions (CR) and non-compression region (NCR) (see FIGS. 2 to 4).

In addition, the non-compression region (NCR) may be a region other than the second penetrating hole (430), the first compressed region (CR1), and the second compressed region (CR2). That is, the non-compression region (NCR) may be a region of the support layer (400) that is not subjected to a separate compression process (see FIGS. 2 to 4).

According to an embodiment, the non-compression region (NCR) may be disposed around the first compressed region (CR1) (see FIG. 2).

According to another embodiment, the non-compression region (NCR) may be disposed around the second compressed region (CR2) (see FIG. 3).

According to still another embodiment, the first compressed region (CR1) may be disposed around the second compressed region (CR2), and the non-compression region (NCR) may be disposed around the first compressed region (CR1). Specifically, the support layer (400) may comprise a second penetrating hole (430) connected to the first penetrating hole (130), the second compressed region (CR2) may be disposed around the second penetrating hole (430), the first compressed region (CR1) may be disposed around the second compressed region (CR2), and the non-compression region (NCR) may be disposed around the first compressed region (CR1) (see FIG. 4).

The polishing pad according to a specific example may comprise a polishing layer (100) having a first penetrating hole (130); a window (200) disposed in the first penetrating hole (130); and a support layer (400) disposed under the lower side (120) of the polishing layer and having a second penetrating hole (430) connected to the first penetrating hole (130).

In such event, the area of the second penetrating hole (430) may be smaller than the area of the first penetrating hole (130). Thus, the second compressed region (CR2) that corresponds to the inner peripheral region of the window (200) may exist in the support layer (400).

That is, if the thickness of the window (200) is greater than the thickness of the polishing layer (100) and if the area of the second penetrating hole (430) is smaller than the area of the first penetrating hole (130), the window (200) can be inserted into the first penetrating hole (130) and compress the support layer (400), so that a part of the support layer (400) is compressed. As a result, the second compressed region (CR2) can be formed.

In addition, the diameter of the second penetrating hole (430) may be smaller than the diameter of the first penetrating hole (130). Thus, the non-compression region (NCR) of the support layer may exist in and around the second compressed region (CR2) of the support layer, which corresponds to the lower side of the window (200). That is, if the thickness of the window (200) is greater than the thickness of the polishing layer (100) and if the diameter of the second penetrating hole (430) is smaller than the diameter of the first penetrating hole (130), the window (200) can be inserted into the first penetrating hole (130) and compress the support layer (400), so that a part of the support layer (400) is compressed.

The diameter (or width) of the second penetrating hole may be smaller than the diameter (or width) of the first penetrating hole. Specifically, the diameter (or width) of the second penetrating hole may be 5 mm to 95 mm.

In addition, the thickness of the first compressed region (CR1) and the thickness of the second compressed region (CR2) may be smaller than the thickness of the non-compression region (NCR). For example, the thickness of the first compressed region (CR1) and the thickness of the second compressed region (CR2) may be 0.1 to 1.5 mm, 0.1 to 1.4 mm, 0.4 to 1.4 mm, or 0.5 to 1.4 mm.

According to an embodiment, the upper side of the second compressed region (CR2) may be disposed further below the upper side of the non-compression region (NCR). The difference in height between the upper side of the second compressed region (CR2) and the upper side of the non-compression region (NCR) may be 0.1 to 1.0 mm or 0.1 to 0.6 mm.

In addition, the lower side of the first compressed region (CR1) may be disposed further above the lower side of the non-compression region (NCR). The difference in height (D1) between the lower side of the first compressed region (CR1) and the lower side of the non-compression region (NCR) may be 0.1 to 2.0 mm or 0.5 to 1.5 mm (see FIG. 2). The first compressed region (CR1) is compressed to have the desired step difference so as to effectively prevent a slurry from flowing into the first compressed region (CR1). As a result, it is more advantageous in reducing a change in the polishing rate.

As shown in FIG. 2, the lower side of the support layer (400) may have a concave shape at the position of the first compressed region (CR1). In such event, it is preferable that the concave shape does not have a sharp or pointed portion.

Specifically, the lower side of the first compressed region (CR1) may have a round portion (450). The radius of curvature of the round portion (450) may be 0.01 mm to 1 mm or 0.05 mm to 0.5 mm.

FIGS. 5*a* to 5*f* are cross-sectional views of a polishing pad according to an embodiment.

FIGS. 10 to 13 are cross-sectional views of a polishing pad according to still another embodiment.

Figure 5A:
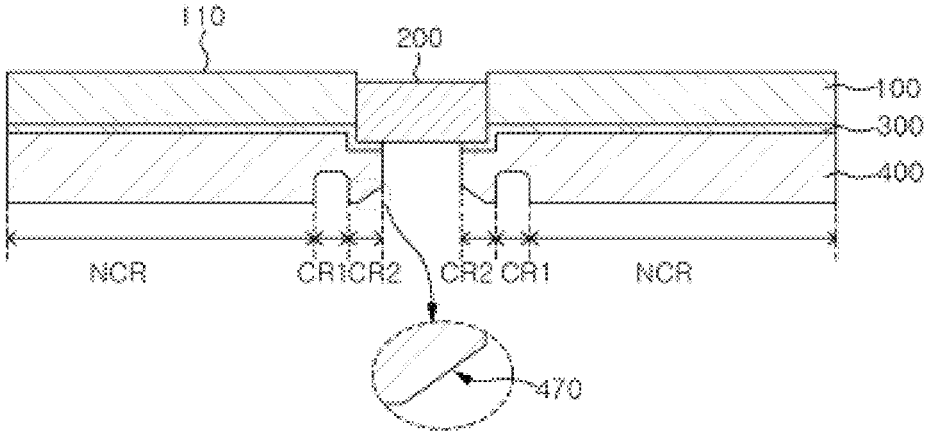
FIGS. 5*a* to 5*f* are cross-sectional views of a polishing pad according to an embodiment.
Figure 5B:
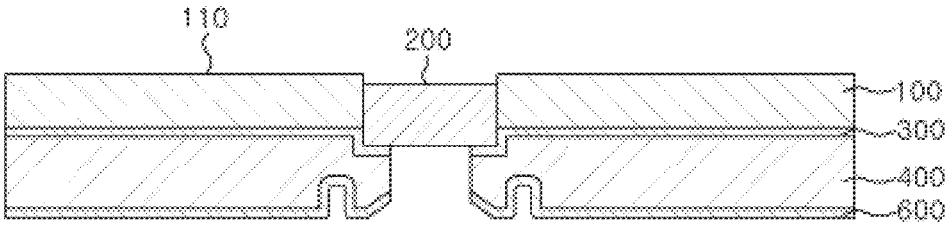

As shown in FIG. 5*b*, the polishing pad may further comprise an adhesive tape (600) under the lower side of the support layer (400). The adhesive tape (600) may be a double-sided adhesive tape. The adhesive tape (600) may serve to adhere the polishing pad to a platen. The first compressed region (CR1) may be formed by compressing the lower side of the adhesive tape (600) while the adhesive tape (600) is attached to the lower side of the support layer (400).

In such event, if a compression tool for forming the first compressed region (CR1) has a sharp or pointed portion, it may be advantageous in performing the compression, but the adhesive tape (600) may be torn or damaged. Thus, a tool that does not have a sharp or pointed portion is used as a compression tool for forming the first compressed region (CR1). The concave shape formed to have a structure that conforms to the shape of such a tool does not have a sharp or pointed portion.

Accordingly, even if an adhesive tape for adhesion with a platen or a release tape for protection is attached to the lower side of the support layer (400), it is possible to prevent that a sharp or pointed portion on the lower side of the first compressed region (CR1) would cut to damage the adhesive tape or the release tape.

According to an embodiment, the first compressed region (CR1) and the second compressed region (CR2) may have a density greater than the density of the non-compression region (NCR).

For example, the density of the first compressed region (CR1) may be in the range of ⅕ to ⅘ or ⅖ to ⅗ of the density of the non-compression region (NCR). In addition, the density of the second compressed region (CR2) may be in the range of ⅕ to ⅘ or ⅖ to ⅗ of the density of the non-compression region (NCR).

According to an embodiment, the thickness of the first compressed region (CR1) and the thickness of the second compressed region (CR2) may be smaller than the thickness of the non-compression region (NCR).

For example, the thickness of the first compressed region (CR1) may be in the range of ⅕ to ⅘ or ⅖ to ⅗ of the thickness of the non-compression region (NCR). In addition, the thickness of the second compressed region (CR2) may be in the range of ⅕ to ⅘ or ⅖ to ⅗ of the thickness of the non-compression region (NCR).

For example, the thickness of the first compressed region (CR1) may be 0.1 to 1.5 mm, 0.1 to 1.4 mm, 0.4 to 1.4 mm, or 0.5 to 1.4 mm. In addition, the thickness of the second compressed region (CR2) may be 0.1 to 1.5 mm, 0.1 to 1.4 mm, 0.4 to 1.4 mm, or 0.5 to 1.4 mm. In addition, the thickness of the non-compression region (NCR) may be 1.0 to 1.5 mm or 1.1 to 1.3 mm.

According to an embodiment, the lower side of the first compressed region (CR1) has a round portion (450).

Referring to FIG. 2, the cross-sectional shape of the lower side of the first compressed region (CR1) may be a rectangular shape having an edge consisting of the round portion (450) when viewed from a cross-section in the thickness direction of the support layer (400). Thus, it is possible to maximize the effect of preventing a slurry or water from flowing into the first compressed region (CR1).

Figure 9:
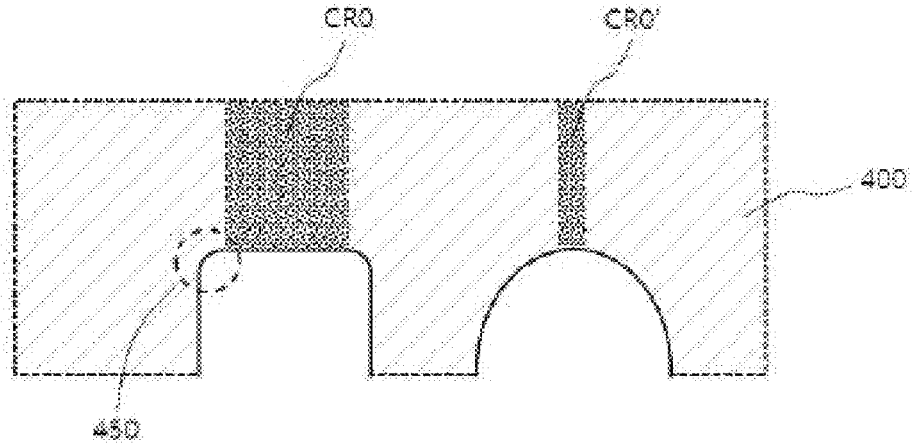
FIG. 9 shows a region uniformly compressed in conformation to the shape of a cross-section of the lower side of a first compressed region.

If the cross-sectional shape of the lower side of the first compressed region (CR1) is hemispherical or semi-elliptical, the uniformly compressed region is reduced as compared with the case of a rectangular shape. Specifically, referring to FIG. 9, if the cross-sectional shape of the lower side of the support layer (400) is a rectangular shape having an edge consisting of the round portion (450), the uniformly compressed region (CR0) may be wide. On the other hand, if it is hemispherical or semi-elliptical, the uniformly compressed region (CR0') may be very narrow. Therefore, the lower side of the first compressed region (CR1) has the round portion (450) as described above, while it has a rectangular shape having a linear portion between the two edges consisting of the round portion (450). As a result, the uniformly compressed region of the support layer (400) can be maximally ensured, and a slurry and water can be effectively prevented from flowing into the support layer (400).

According to an embodiment, the lower side of the second compressed region (CR2) may have an oblique portion (470) inclined upward with respect to the lower side of the non-compression region (NCR) (see FIG. 5*a*).

First Adhesive Layer (300) and Second Adhesive Layer (500)

The polishing layer (100) and the support layer (400) may be adhered to each other. In such event, the polishing layer (100) and the support layer (400) may be adhered to each other by heat and/or pressure. In addition, when the polishing layer (100) and the support layer (400) are adhered to each other, the first penetrating hole (130) in the polishing layer (100) and the second penetrating hole (430) in the support layer (400) may be aligned to correspond to each other.

According to an embodiment, the polishing pad may further comprise a first adhesive layer (300) disposed between the window (200) and the support layer (400) and between the polishing layer (100) and the support layer (400).

The first adhesive layer (300) serves to adhere the polishing layer (100) and the support layer (400) to each other. Further, the first adhesive layer (300) may suppress a polishing liquid from leaking from the upper portion of the polishing layer (400) downward the support layer (400).

Referring to FIGS. 2 to 4, the first adhesive layer (300) may be disposed between the polishing layer (100) and the support layer (400) in the first compressed region (CR1) and the non-compression region (NCR).

In addition, a part of the first adhesive layer (300) may adhere the window (200) and the support layer (400). Referring to FIGS. 3 and 4, a part of the first adhesive layer (300) may be disposed between the window (200) and the support layer (400). More specifically, a part of the first adhesive layer (300) may be disposed between a part of the lower side (220) of the window and the support layer (400) in the second compressed region (CR2). In addition, a part of the first adhesive layer (300) may be disposed on a part of the lateral side of the window (200) and between the polishing layer (100) and the support layer (400).

The first adhesive layer (300) may comprise a third penetrating hole that passes through it in the thickness direction thereof.

The third penetrating hole may be disposed in a region corresponding to the region in which the second penetrating hole (430) is formed in the support layer (400). Thus, the first penetrating hole (130) in the polishing layer (100) and the second penetrating hole (430) in the support layer (400) may be connected to each other through the third penetrating hole. In addition, the area of the third penetrating hole (that is, the area of the third penetrating hole in the plane of the adhesive layer) may be the same as the area of the second penetrating hole (430).

According to an embodiment, the polishing pad may further comprise a second adhesive layer (500) disposed on one side of the window (200) in contact with the second compressed region (CR2). Specifically, the polishing pad may further comprise a second adhesive layer (500) disposed under the lower side of the window (200) in contact with the second compressed region (CR2).

Figure 5C:
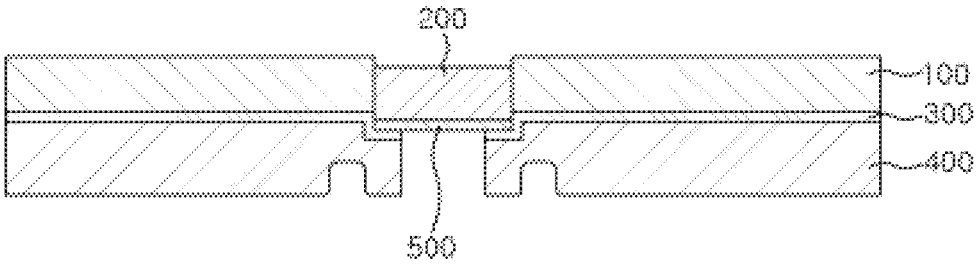
Figure 10:
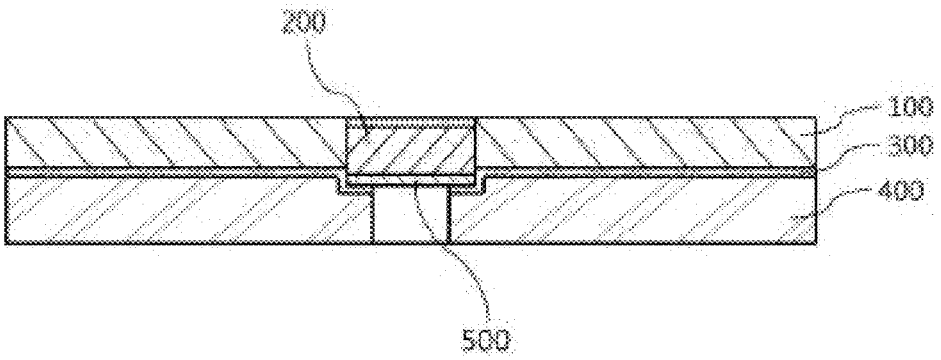
FIGS. 10 to 13 are cross-sectional views of a polishing pad according to still another embodiment.

The polishing pad according to an embodiment may comprise a first adhesive layer (300) adhered between the window (200) and the second compressed region (CR2); and a second adhesive layer (500) disposed under the lower side of the window (200) (see FIGS. 5*c* and 10).

According to an embodiment, the first adhesive layer (300) and the second adhesive layer (500) may have a single layer or a multilayer structure of two or more layers.

The first adhesive layer (300) and the second adhesive layer (500) may comprise a hot-melt adhesive. Specifically, the first adhesive layer (300) and the second adhesive layer (500) may comprise a hot-melt adhesive having a melting point of 90° C. to 130° C. More specifically, the first adhesive layer (300) and the second adhesive layer (500) may comprise a hot-melt adhesive having a melting point of 110° C. to 130° C.

The hot-melt adhesive may be at least one selected from the group consisting of a polyurethane resin, a polyester resin, an ethylene-vinyl acetate resin, a polyamide resin, and a polyolefin resin. Specifically, the hot-melt adhesive may be at least one selected from the group consisting of a polyurethane resin and a polyester resin.

According to an embodiment, the thickness of the first adhesive layer (300) and the thickness of the second adhesive layer (500) may be 20 μm to 30 μm. For example, the thickness of the first adhesive layer (300) and the thickness of the second adhesive layer (500) may be 20 μm to 30 μm, specifically 23 μm to 27 μm. More specifically, the thickness of the first adhesive layer (300) may be 20 μm to 30 μm, and the thickness of the second adhesive layer (500) may be 5 μm to 30 μm.

Figure 5D:
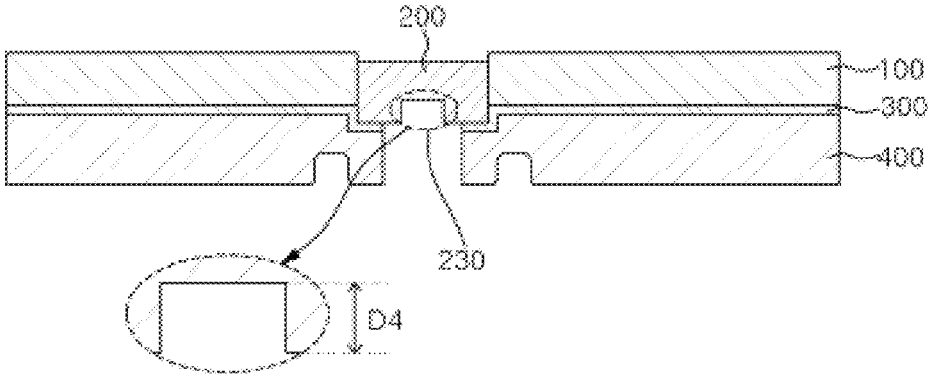
Figure 11:
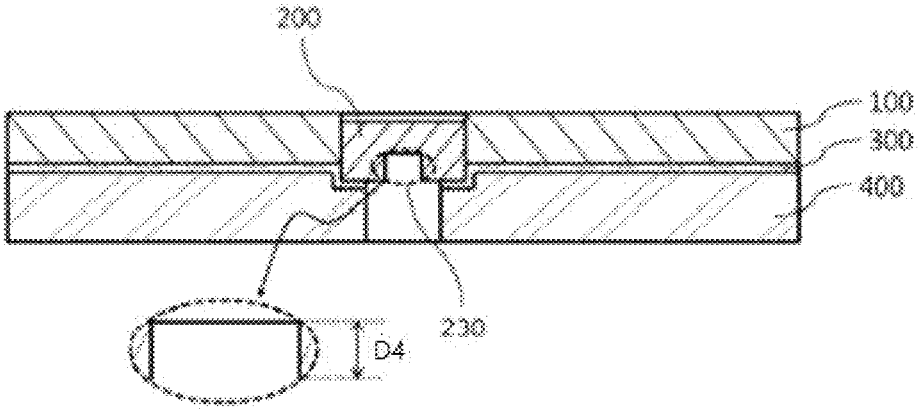

The polishing pad according to another embodiment may comprise a polishing layer (100) having a first penetrating hole; a window (200) disposed in the first penetrating hole and comprising a recess; and a support layer (400) disposed under the lower side of the polishing layer and comprising a second penetrating hole; and a first adhesive layer (300) disposed between the polishing layer and the support layer and comprising a third penetrating hole (see FIGS. 5*d* and 11).

Figure 5E:
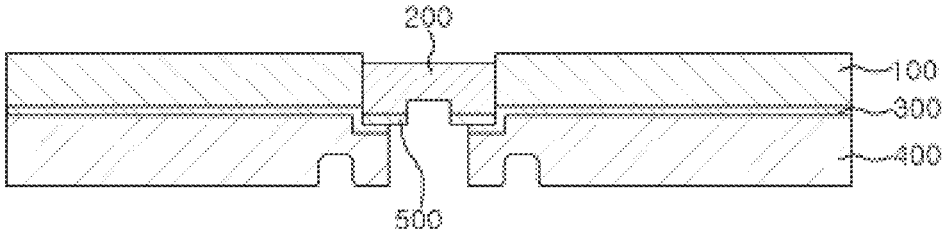
Figure 12:
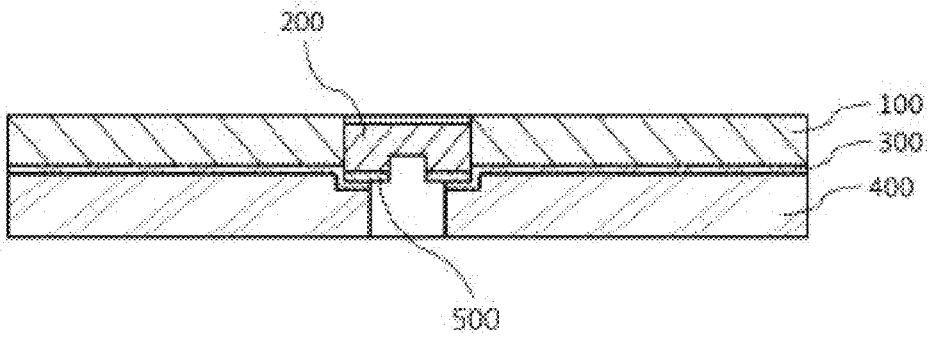

The polishing pad according to still another embodiment may comprise a polishing layer (100) having a first penetrating hole; a window (200) disposed in the first penetrating hole and comprising a recess; and a support layer (400) disposed under the lower side of the polishing layer and comprising a second penetrating hole; a first adhesive layer (300) disposed between the polishing layer and the support layer and comprising a third penetrating hole; and a second adhesive layer (500) disposed under the lower side of the window (see FIGS. 5*e* and 12).

Figure 5F:
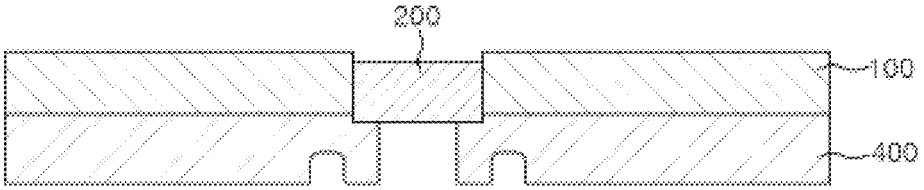
Figure 13:
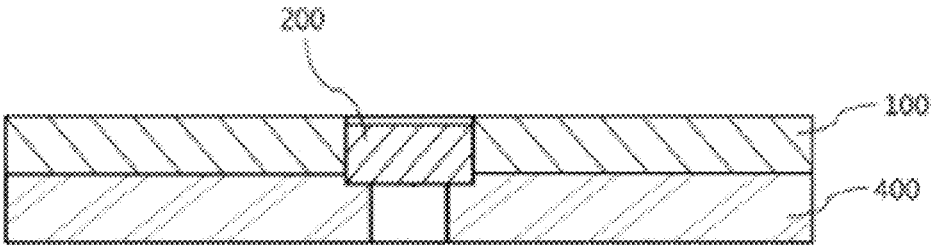

In the polishing pad according to an embodiment, the polishing layer (100) and the support layer (400) may be directed bonded to each other without the first adhesive layer and the second adhesive layer (see FIGS. 5*f* and 13). In such event, the window (200) and the support layer (400) may be directly bonded to each other without an adhesive layer or may be adhered to each other by an adhesive layer.

Process for Preparing a Polishing Pad

The process for preparing a polishing pad according to an embodiment comprises (1) preparing a polishing layer having a first penetrating hole; (2) adhering a support layer to the lower side of the polishing layer; (3) inserting a window into the first penetrating hole; and (4) (4-1) pressing the lower side of the support layer to form a first compressed region in a region of the support layer that corresponds to the outer peripheral region of the window, and (4-2) pressing the window to form a second compressed region in a region of the support layer that corresponds to the inner peripheral region of the window.

Figure 6:
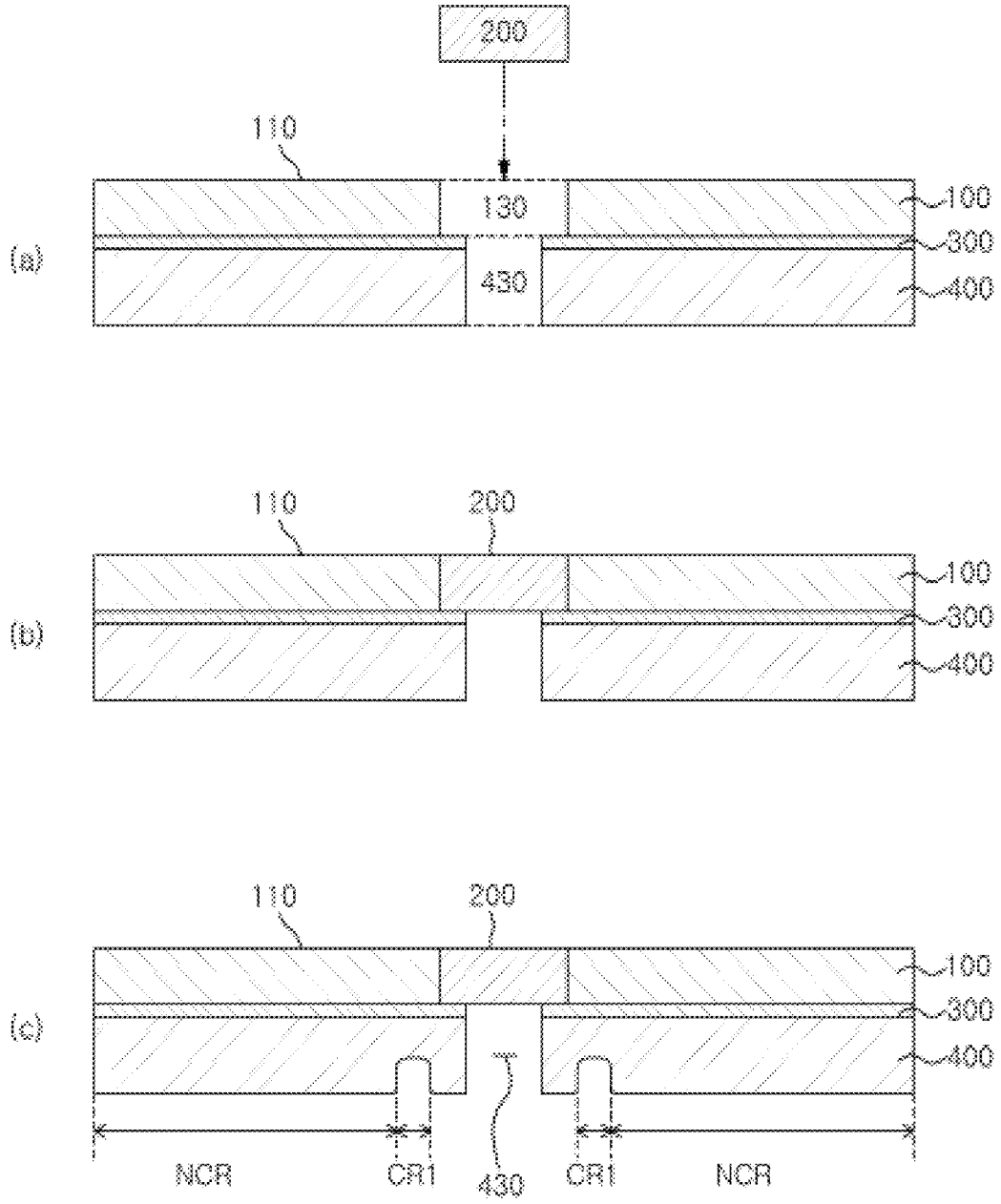
FIG. 6 illustrates a process for preparing a polishing pad according to an embodiment.

FIG. 6 illustrates a process for preparing a polishing pad according to an embodiment. Specifically, it comprises (1) preparing a polishing layer having a first penetrating hole; (2) adhering a support layer to the lower side of the polishing layer; (3) inserting a window into the first penetrating hole; and (4-1) pressing the lower side of the support layer to form a first compressed region in a region of the support layer that corresponds to the outer peripheral region of the window.

Figure 7:
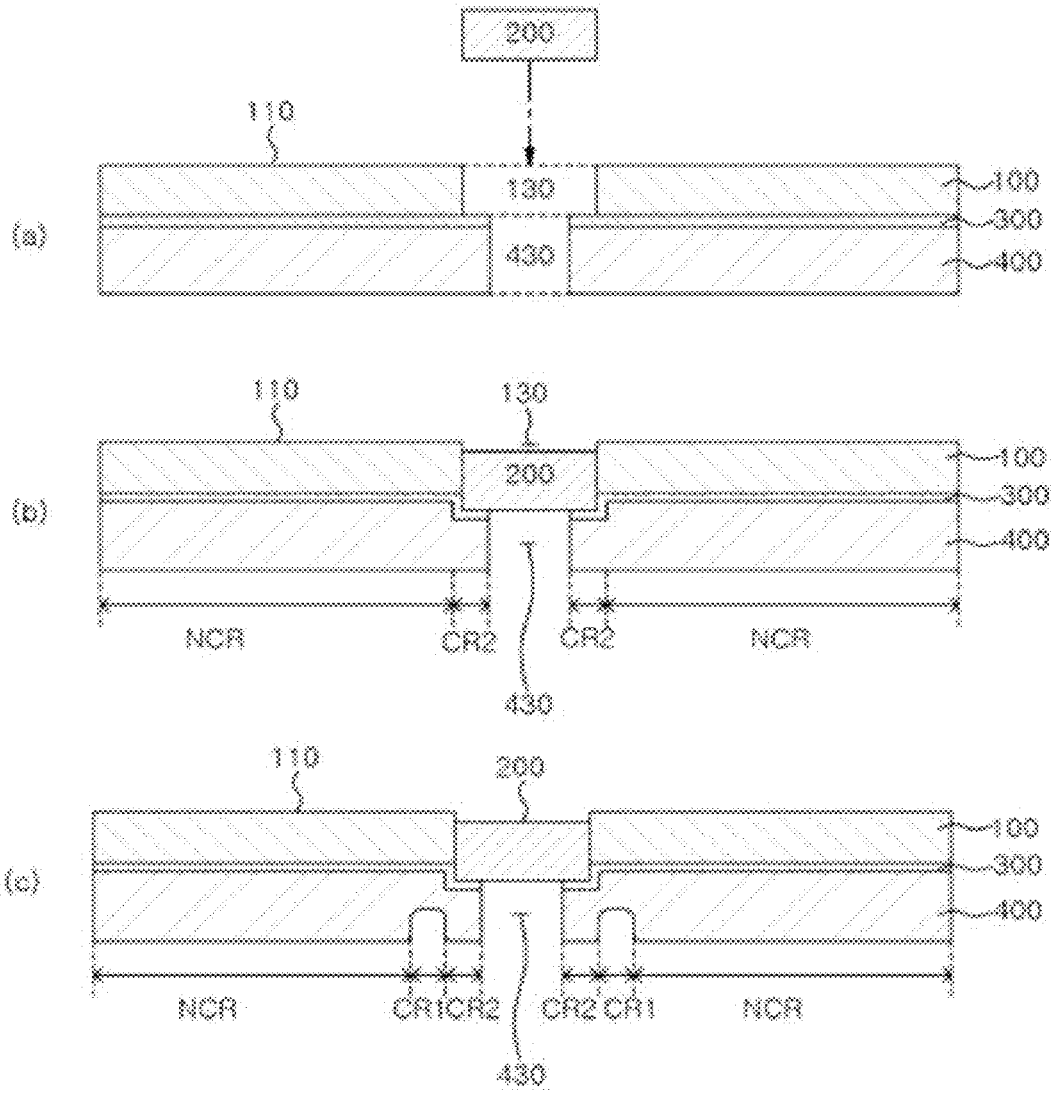
FIG. 7 illustrates a process for preparing a polishing pad according to another embodiment.

FIG. 7 illustrates a process for preparing a polishing pad according to another embodiment. Specifically, it comprises (1) preparing a polishing layer having a first penetrating hole; (2) adhering a support layer to the lower side of the polishing layer; (3) inserting a window into the first penetrating hole; and (4) (4-1) pressing the lower side of the support layer to form a first compressed region in a region of the support layer that corresponds to the outer peripheral region of the window, and (4-2) pressing the window to form a second compressed region in a region of the support layer that corresponds to the inner peripheral region of the window.

Figure 14:
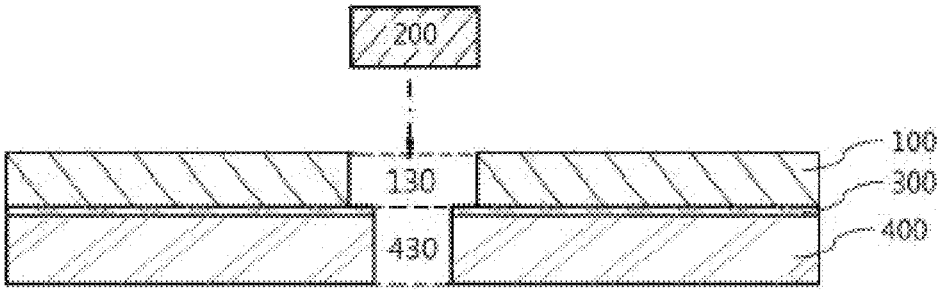
FIGS. 14 and 15 illustrate a process for preparing a polishing pad according to still another embodiment.
Figure 15:
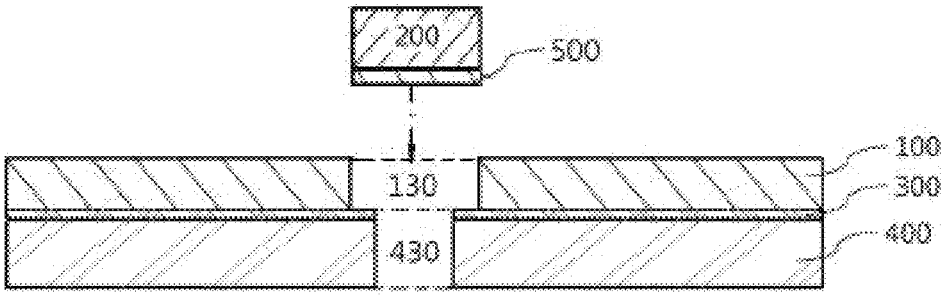

FIGS. 14 and 15 illustrate a process for preparing a polishing pad according to still another embodiment. Specifically, it comprises (1) preparing a polishing layer having a first penetrating hole; (2) adhering a support layer to the lower side of the polishing layer; (3) inserting a window into the first penetrating hole; and (4-2) pressing the window to form a second compressed region in a region of the support layer that corresponds to the inner peripheral region of the window (see FIG. 6).

The description on the polishing layer, the support layer, the first compressed region, the second compressed region, the first adhesive layer, and the second adhesive layer is the same as described above.

First, a polishing layer having a first penetrating hole is prepared (step 1).

The polishing layer may be formed by a process in which a prepolymer, a foaming agent, and a curing agent are mixed, cured and foamed at the same time in a mold, or by a process that further comprises a cutting step and a grinding step. Thereafter, a first penetrating hole may be formed by a punching step.

Next, a support layer is adhered to the lower side of the polishing layer (step (2)).

A support layer may be bonded to the lower side of the polishing layer (100), which comprises a first penetrating hole (130).

The support layer may comprise a nonwoven fabric or a porous pad as described above. Specifically, the support layer may be composed of a nonwoven fabric or a porous pad.

In addition, when the polishing layer and the support layer are bonded to each other, the first penetrating hole in the polishing layer and the second penetrating hole in the support layer may be aligned to correspond to each other.

The adhesion between the polishing layer and the support layer may be achieved through a first adhesive layer disposed between the polishing layer and the support layer. Specifically, the first adhesive layer may be disposed under the lower side of the polishing layer or on the upper side of the support layer, and the polishing layer and the support layer may be adhered by the first adhesive layer.

The first adhesive layer may comprise a hot-melt adhesive as described above. That is, the polishing layer and the support layer may be adhered to each other by heat and/or pressure.

The process for preparing a polishing pad according to an embodiment may further comprise forming a second penetrating hole in the support layer that is connected to the first penetrating hole and having an area smaller than the area of the first penetrating hole.

The second penetrating hole may be formed by a punching step, but it is not limited thereto.

A third penetrating hole may be further formed in the first adhesive layer.

Figure 8A:
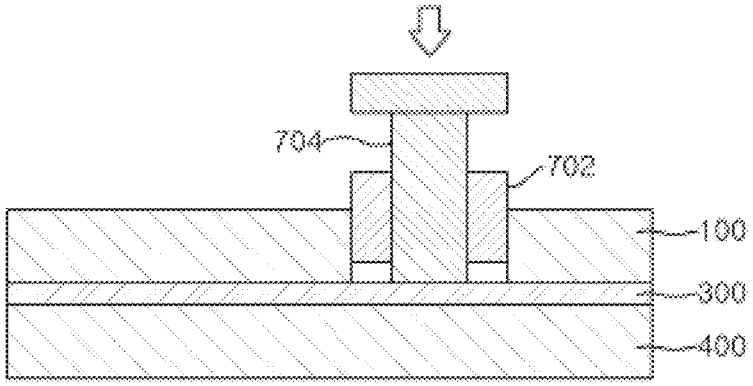
FIGS. 8*a* and 8*b* show a method of forming a second penetrating hole and a third penetrating hole.
Figure 8B:
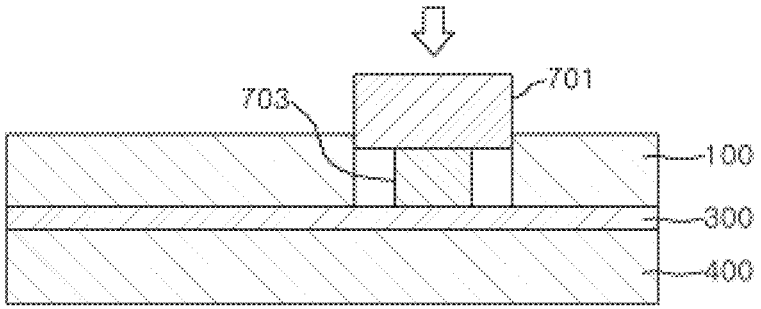

FIGS. 8*a* and 8*b* show a method of forming a second penetrating hole and a third penetrating hole.

The third penetrating hole may be formed by a punching step. When the polishing layer and the support layer are adhered to each other by the first adhesive layer, the first penetrating hole in the polishing layer, the second penetrating hole in the support layer, and the third penetrating hole in the first adhesive layer may be aligned to correspond to each other.

Alternatively, the polishing layer having a first penetrating hole is adhered to the support layer by the first adhesive layer. Then, a third penetrating hole is formed in a predetermined region of the first adhesive layer with reference to the first penetrating hole. And a second penetrating hole may be formed in a predetermined region of the support layer.

Specifically, the second penetrating hole and the third penetrating hole may be formed within a region corresponding to the first penetrating hole. According to the above, the first penetrating hole, the second penetrating hole, and the third penetrating hole may be connected to each other. In such event, the second penetrating hole and the third penetrating hole both may have an area smaller than the area of the first penetrating hole. As a result, a part of the first adhesive layer may be exposed by the first penetrating hole. That is, a part of the first adhesive layer may be disposed in the region in which the first penetrating hole is formed.

The second penetrating hole and the third penetrating hole may be formed at the same time.

The method of forming the second penetrating hole and the third penetrating hole may be a method of cutting them using a guide member. Specifically, this method may comprise inserting a guide member into the first penetrating hole; aligning a cutting member at a predetermined position by the guide member; and cutting a part of the first adhesive layer and a part of the support layer by the cutting member.

Referring to FIGS. 8*a* and 8*b*, in order to form the third penetrating hole and the second penetrating hole, a guide member (701) to which a cutting member (703) has been fixed may be used, or a cutting member (704) may be guided by a guide member (702).

The cutting member may be fixed to the guide member or guided by the guide member. In addition, the guide member may be in contact with the inner side of the first penetrating hole to guide the cutting member. Further, the cutting member may cut the first adhesive layer and the support layer at the same time.

Next, a window is inserted into the first penetrating hole (step (3)).

A window is inserted into the first penetrating hole. Thereafter, the window may be adhered to the support layer. Specifically, the window may be inserted into the first penetrating hole and adhered to the support layer at the same time. That is, the window may be adhered to the support layer by a part of the first adhesive layer.

The window may be adhered to the support layer by heat and/or pressure. For example, after the window has been inserted, a part of the first adhesive layer may adhere the window and the support layer by the heat and/or pressure applied through the window.

In addition, the first adhesive layer comprises a hot-melt adhesive. Heat and/or pressure is applied to the first adhesive layer through the window. As a result, a part of the window and the support layer may be adhered to each other by the adhesive.

Alternatively, the window and the support layer may be adhered to each other by vibration and pressure applied to the window. That is, frictional heat is generated in the first adhesive layer by the vibration applied to the window, whereby the window and the supporting layer can be adhered to each other.

In addition, a second adhesive layer may be disposed under the lower side of the window prior to the insertion of the window. That is, the window may be inserted into the first penetrating hole while the second adhesive layer is adhered to the lower side of the window. The second adhesive layer may enhance the adhesion between the window and the support layer.

Next, the lower side of the support layer is pressed to form a first compressed region in a region of the support layer that corresponds to the outer peripheral region of the window (step (4-1)).

As shown in FIGS. 6 and 7, after the window (200) is disposed in the first penetrating hole (130), a first compression region (CR1) may be formed in the support layer (400).

In the step of forming the first compressed region, the lower side of the support layer may be pressed by a pressing member that comprises a round portion. In such event, the round portion may be in direct or indirect contact with the lower side of the support layer to press it.

For example, the pressing member, which comprises a round portion, may be a pressing member that comprises a rectangular protruding portion with rounded edges. For example, the formation of the first compressed region may be carried out by pressing a mold having a protrusion to the lower side of the support layer. In such event, the protruding portion may have a rectangular shape with rounded edges when viewed from a cross-section in the vertical direction.

Next, the window is pressed to form a second compressed region in a region of the support layer that corresponds to the inner peripheral region of the window (step (4-2)).

As shown in FIG. 7, when the window (200) is disposed in the first penetrating hole (130) in the polishing layer, a second compression region (CR2) may be formed in the support layer (400). Specifically, the heat and/or pressure applied through the window is transmitted to the support layer. A part of the support layer may be compressed by the heat and/or pressure to form the second compressed region.

In such event, the area of the second penetrating hole may be smaller than the area of the first penetrating hole. Thus, the window and the support layer may be adhered to each other through the first adhesive layer by the heat and pressure applied to the window or the support layer, and the second compressed region may be formed in the support layer at the same time.

In addition, since a part of the support layer is compressed to form the second compressed region, the lower side of the window may be disposed further below the lower side of the polishing layer. Specifically, if the thickness of the window (200) is greater than the thickness of the polishing layer (100) and if the area of the first penetrating hole (130) in the polishing layer is greater than the area of the second penetrating hole (430) in the support layer, a part of the support layer may be compressed to form a compressed region.

Specifically, if the thickness of the window (200) is greater than the thickness of the polishing layer (100) and if the area of the first penetrating hole (130) in the polishing layer is greater than the area of the second penetrating hole (430) in the support layer, a part of the support layer may be compressed to form a second compressed region.

The window and the support layer may be adhered to each other by the first adhesive layer. The first adhesive layer may comprise a hot-melt adhesive. The window and the support layer may be adhered to each other through the first adhesive layer by the heat and pressure applied to the window or the support layer, and the second compressed region may be formed at the same time.

As the polishing pad prepared in this way has excellent airtightness between the polishing layer and the window, it has improved sealing characteristics. Thus, it is possible to suppress the leakage of a slurry during a polishing process such as a CMP process. Specifically, the support layer of the polishing pad comprises a compressed region. Since the compressed region is compressed by heat and/or pressure to have a low porosity, it is possible to prevent the leakage of water or a slurry without a separate leakage-proof layer.

In addition, even if a slurry is leaked between the window and the polishing layer, the compressed region of the polishing pad can secondarily suppress the leakage of the slurry. In particular, since the support layer of the polishing pad is compressed in the outer peripheral region of the window, the effect of suppressing the leakage of water as described above is excellent. The compression can be readily carried out by pressing the lower side of the support layer, which is advantageously applicable to the industry.

In addition, according to a preferred embodiment, since the support layer of the polishing pad is additionally compressed in the inner peripheral region of the window, the effect of preventing leakage can be further enhanced. The additional compression can be easily implemented by the lower side of the window, which is more projected than the lower side of the polishing layer. In addition, in such event, the path between the polishing layer and the window and between the support layer and the window along which leakage may occur becomes longer, so that the effect of preventing leakage can be maximized.

In addition, according to a preferred embodiment, the polishing pad may further comprise an adhesive layer, wherein the adhesive layer is disposed between the polishing layer and the support layer, between a part of the lower side of the window and the support layer, and between a part of the lateral side of the window and the support layer. Thus, all the path along which leakage may occur can be sealed by the adhesive layer.

REFERENCE NUMERAL OF THE DRAWINGS

| | |
|---|---|
| 100: polishing layer | 110: upper side of a polishing layer |
| 120: lower side of a polishing layer | 130: first penetrating hole |
| 200: window | 210: upper side of a window |
| 220: lower side of a window | |
| 230: recess disposed on the lower side of a window | |
| 300: first adhesive layer | 400: support layer |
| 430: second penetrating hole | 450: round portion |
| 470: oblique portion | 500: second adhesive layer |
| 600: adhesive tape | 701, 702: guide member |
| 703, 704: cutting member | |

D1: difference in height between the lower side of a first compressed region and the lower side of a non-compression region in a support layer D2: difference in height between the lower side of a polishing layer and the lower side of a window D3: difference in height between the upper side of a polishing layer and the upper side of a window D4: depth of a recess disposed on the lower side of a window CR1: first compressed region of a support layer CR2: second compressed region of a support layer NCR: non-compression region of a support layer CR0, CR0': uniformly compressed region

The invention claimed is:

1. A polishing pad, which comprises:

a polishing layer having a first penetrating hole;

a support layer disposed under the polishing layer; and a window disposed in the first penetrating hole, wherein the support layer comprises a first compressed region disposed in a region corresponding to an outer peripheral region of the window and a second compressed region disposed in a region corresponding to an inner peripheral region of the window, wherein the second compressed region is disposed to support a lower surface of the window, and wherein a compressed portion of the support layer is provided to the second compressed region.

2. The polishing pad of claim 1, wherein the support layer comprises a non-compression region in a region excluding the first compressed region or the second compressed region.

3. The polishing pad of claim 2, wherein the first compressed region and the second compressed region have a density greater than the density of the non-compression region.

4. The polishing pad of claim 2, wherein the first compressed region and the second compressed region have a thickness smaller than the thickness of the non-compression region.

5. The polishing pad of claim 2, wherein the upper side of the second compressed region is disposed further below the upper side of the non-compression region, and the difference in height between the upper side of the second compressed region and the upper side of the non-compression region is 0.1 mm to 1.0 mm.

6. The polishing pad of claim 1, wherein the lower side of the first compressed region has a round portion, and the radius of curvature of the round portion is 0.01 mm to 1 mm.

7. The polishing pad of claim 1, wherein the support layer comprises a second penetrating hole connected to the first penetrating hole, and the second penetrating hole has an area smaller than the area of the first penetrating hole.

8. The polishing pad of claim 1, wherein the thickness of the window is greater than the thickness of the polishing layer.

9. The polishing pad of claim 1, wherein at least a part of the lower side of the window is disposed further below the lower side of the polishing layer, and the difference in height between the lower side of the polishing layer and the lower side of the window is 0.1 mm to 1.0 mm.

10. The polishing pad of claim 1, wherein the upper side of the window is as high as the upper side of the polishing layer or is lower than the upper side of the polishing layer.

11. The polishing pad of claim 10, wherein the upper side of the window is disposed further below the upper side of the polishing layer, and the difference in height between the upper side of the polishing layer and the upper side of the window is 0.001 mm to 0.05 mm.

12. The polishing pad of claim 1, which further comprises a first adhesive layer disposed between the window and the support layer and between the polishing layer and the support layer.

13. The polishing pad of claim 12, which further comprises a first adhesive layer disposed between the polishing layer and the support layer, between the lateral side of the window and the support layer, and between the lower side of the window and the upper side of the second compressed region.

14. The polishing pad of claim 12, which further comprises a second adhesive layer disposed on one side of the window in contact with the second compressed region.

15. The polishing pad of claim 14, wherein the thickness of the first adhesive layer and the thickness of the second adhesive layer are 20 μm to 30 μm.

16. The polishing pad of claim 1, wherein the thickness of the polishing layer is 1.5 mm to 2.5 mm, the thickness of the support layer is 1.0 mm to 1.5 mm, and the thickness of the window is 2.0 mm to 3.0 mm.

17. The polishing pad of claim 1, wherein the window comprises a recess on the lower side thereof, wherein the depth of the recess is 0.1 mm to 2.5 mm.

18. A process for preparing a polishing pad, which comprises:

(1) preparing a polishing layer having a first penetrating hole;

(2) adhering a support layer to the lower side of the polishing layer;

(3) inserting a window into the first penetrating hole; and (4) (4-1) pressing the lower side of the support layer to form a first compressed region in a region of the support layer that corresponds to the outer peripheral region of the window, and (4-2) pressing a portion of the support layer with the window to form a second compressed region in a region of the support layer that corresponds to the inner peripheral region of the window, wherein the second compressed region is disposed in a region facing a lower surface of the window.

19. The process for preparing a polishing pad of claim 18, which further comprises forming a second penetrating hole connected to the first penetrating hole and having an area smaller than the area of the first penetrating hole.

20. The process for preparing a polishing pad of claim 19, wherein the round portion is in direct or indirect contact with the lower side of the support layer to press it.

21. The process for preparing a polishing pad of claim 18, wherein the step (4) comprises the step (4-1) of forming the first compressed region, and in the step (4-1) of forming the first compressed region, the lower side of the support layer is pressed by a pressing member that comprises a round portion.

* * * * *